US008562053B2

(12) United States Patent
Davidson et al.

(10) Patent No.: US 8,562,053 B2
(45) Date of Patent: Oct. 22, 2013

(54) HOIST RING ASSEMBLY AND METHOD

(76) Inventors: Bernard J. Davidson, Valdosta, GA (US); Tony J. Alba, Covina, CA (US)

( * ) Notice: Subject to any disclaimer, the term of this patent is extended or adjusted under 35 U.S.C. 154(b) by 0 days.

(21) Appl. No.: 13/233,696

(22) Filed: Sep. 15, 2011

(65) Prior Publication Data

US 2012/0061982 A1 Mar. 15, 2012

Related U.S. Application Data

(60) Provisional application No. 61/383,236, filed on Sep. 15, 2010.

(51) Int. Cl.
*B66F 19/00* (2006.01)

(52) U.S. Cl.
USPC ..... 294/215; 294/82.1; 403/78; 403/164

(58) Field of Classification Search
USPC ..... 294/215, 82.1; 403/78, 79, 164
See application file for complete search history.

(56) References Cited

U.S. PATENT DOCUMENTS 4,641,986 A 2/1987 Tsui et al.
4,705,422 A * 11/1987 Tsui et al. ..... 403/60
5,352,056 A 10/1994 Chandler
5,586,801 A * 12/1996 Sawyer et al. ..... 294/215
5,848,815 A * 12/1998 Tsui et al. ..... 294/215
6,199,925 B1 * 3/2001 Alba ..... 294/215
6,533,488 B2 * 3/2003 Blenkush et al. ..... 403/79
2002/0164198 A1 * 11/2002 Alba ..... 403/78
2002/0185873 A1 12/2002 Alba
2004/0032134 A1 * 2/2004 Hageman ..... 294/1.1
2005/0012346 A1 * 1/2005 Buck ..... 294/1.1
2010/0207406 A1 8/2010 Thomeczek
2011/0175384 A1 * 7/2011 Segura ..... 294/82.1

OTHER PUBLICATIONS

KIPO International Search Report (ISR) and Written Opinion in co-pending application PCT/US2011/051790.

* cited by examiner

*Primary Examiner* — Saul Rodriguez
*Assistant Examiner* — Gabriela Puig
(74) *Attorney, Agent, or Firm* — Lance M. Pritikin, Esq.

(57) ABSTRACT

A hoist ring assembly includes an anchor subassembly with bushing, retainer and threaded fastener elements, and a loop subassembly with a lifting loop and pair of pin elements. The assembly is adapted such that the lifting loop is rotatable through a 360-degree angle about a major axis, and pivotable through at least 180-degree angle about a minor axis. The assembly can be rapidly assembled or disassembled, and incorporates one or more components which may be substantially fabricated by way of forging operation, particularly the retainer member.

4 Claims, 10 Drawing Sheets

HOIST RING ASSEMBLY AND METHOD

RELATED APPLICATIONS

This application claims the benefit of U.S. Provisional Application No. 61/383,236, filed on Sep. 15, 2010, the content of which is incorporated by this reference in its entirety for all purposes as if fully set forth herein.

TECHNICAL FIELD

The present invention relates generally to the field of hoist ring assemblies. More particularly, the invention concerns hoist ring assemblies with components adapted to be formed by forging and, in some cases, assembled as-forged.

BACKGROUND

Hoist ring assemblies for use in the lifting of heavy loads should be robustly designed to ensure safety. Additionally, it is highly desirable for such assemblies to incorporate features which allow for ease of assembly, and rapid attachment to and removal from a load. Those in the art recognize the need for improvements in the features of such hoist ring assemblies, while employing the use of components designed to be less expensive to fabricate.

SUMMARY

Deficiencies in the prior art are overcome by the provision of a hoist ring assembly comprising an anchor subassembly and a loop subassembly. The anchor subassembly may include a bushing element, a retainer element and a threaded fastener element. The loop subassembly may include a lifting loop and a pair of pin elements.

The bushing element may have a near end, a remote end, a cylindrical portion extending generally therebetween along a major axis, a bushing bore extending axially through the cylindrical portion, and a flange portion extending generally radially outward from the cylindrical portion proximate the remote end. The retainer element may have a first end and a second end, a retainer bore extending therebetween, and a pair of slotted walls disposed oppositely along a minor axis. Each of the slotted walls may have a retainer slot with a slot open end at generally the second end. The retainer bore may be adapted to rotatably receive the cylindrical portion when the hoist ring assembly is in its assembled configuration. The threaded fastener element may be adapted to extend through the bushing bore for securing the hoist ring assembly to a load.

The lifting loop element may have a pair of legs, each of which have a free end with a pin bore. Each of the pin elements may have a proximal portion, a distal portion and a medial portion therebetween. The distal portion may be adapted to be received by a respective one of the pin bores. The medial portion may adapted to be received by a respective one of the retainer slots such that when the hoist ring assembly is in its assembled configuration, the lifting loop element is connected to the anchor subassembly and is rotatable through a 360-degree angle about the major axis with respect to the bushing element with the minor axis remaining generally perpendicular to the major axis, and pivotable through at least approximately a 180-degree angle about the minor axis with respect to the anchor subassembly.

BRIEF DESCRIPTION OF THE DRAWINGS

Further advantages of the present invention may become apparent to those skilled in the art with the benefit of the following detailed description of the preferred embodiments and upon reference to the accompanying drawings in which.

Figure 24:
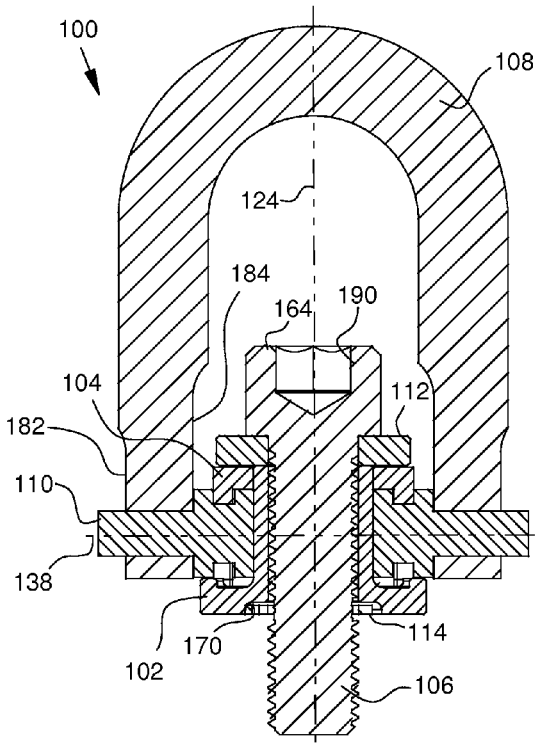
FIG. 24 is a diagrammatic cross-sectional view taken along line 24-24 of FIG. 23.
Figure 25:
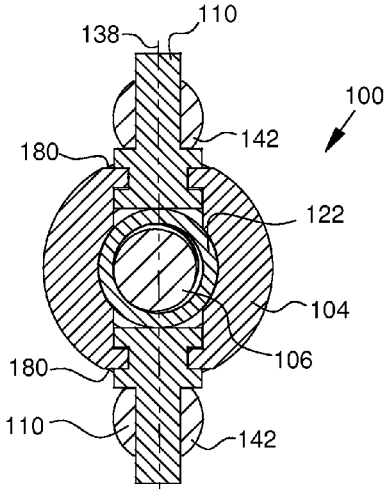
FIG. 25 is a diagrammatic cross-sectional view taken along line 25-25 of FIG. 23.
Figure 30:
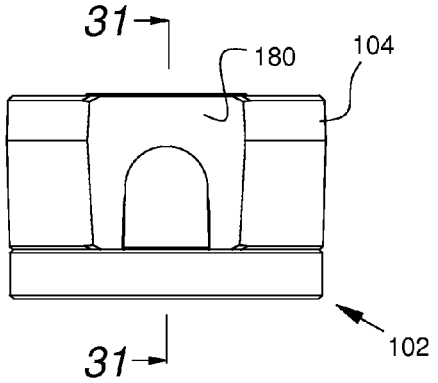
FIG. 30 is a diagrammatic side view of a bushing element and a retainer element of the embodiments shown in FIGS. 10 and 20, wherein the retainer bore of the retainer element is in rotatable receiving engagement with the cylindrical portion of the bushing member.
Figure 31:
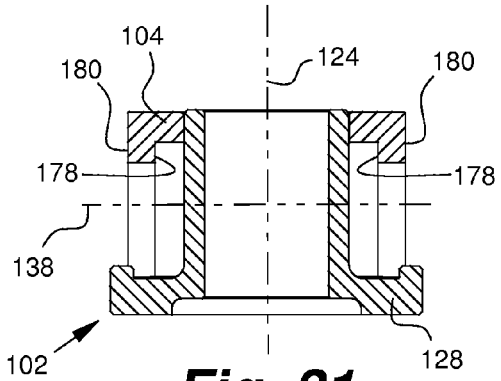
Figure 32:
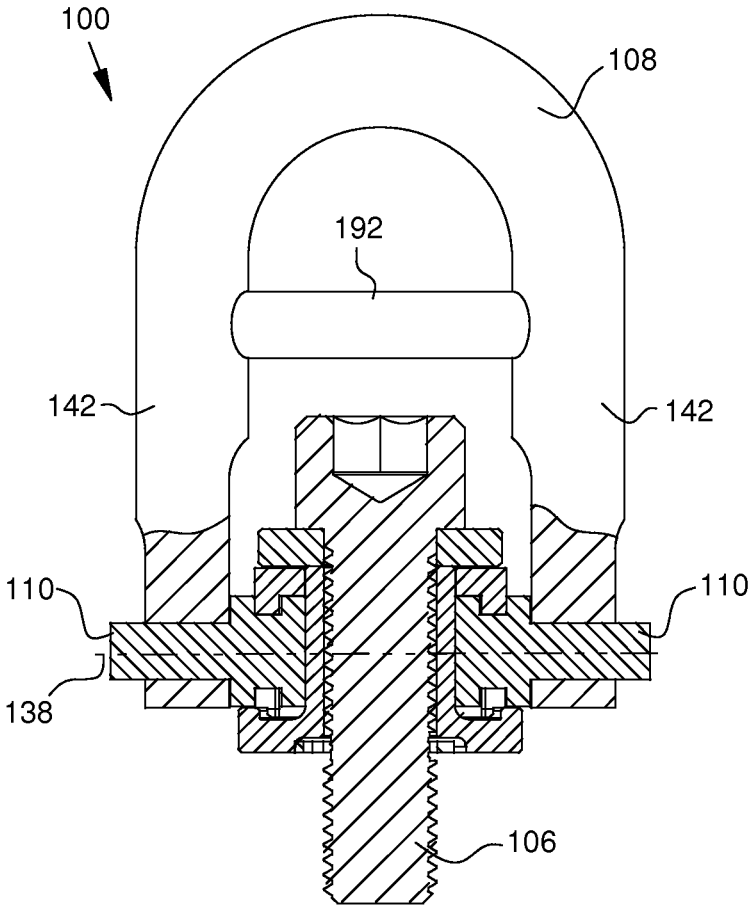

FIG. 31 is a diagrammatic cross-sectional view taken along line 31-31 of FIG. 30; and FIG. 32 is a diagrammatic partial cross-sectional view of an embodiment similar to that shown in FIG. 24, but in which the lifting loop member includes a cross-bar member.

DETAILED DESCRIPTION OF THE PREFERRED EMBODIMENTS

Referring now to the drawings, like reference numerals designate identical or corresponding features throughout the several views.

Figure 1:
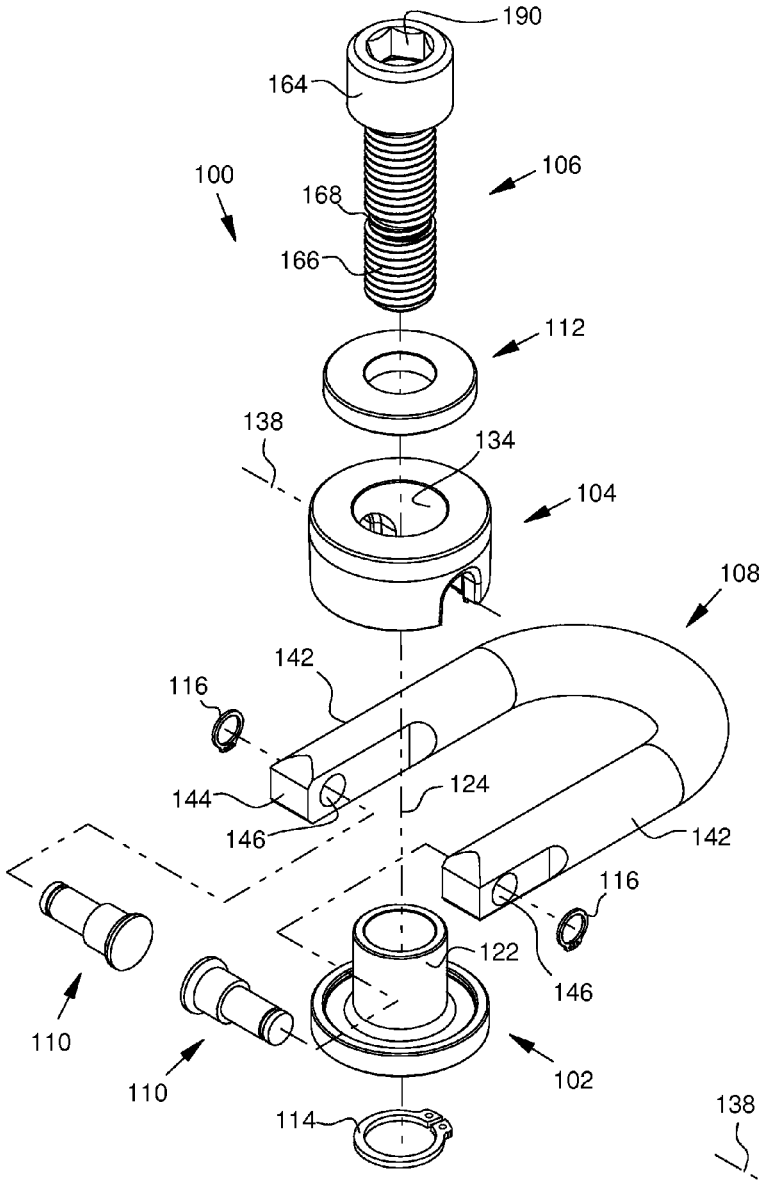
FIG. 1 is a diagrammatic exploded view of an embodiment of a hoist ring assembly.

Embodiments of a hoist ring assembly are shown generally at 100. A hoist ring assembly 100 comprises an anchor subassembly and a lifting loop subassembly. Referring to FIG. 1 for illustration, an anchor subassembly may include a bushing element 102, a retainer element 104 and a threaded fastener element 106. A loop subassembly may include a lifting loop element 108 and a pair of pin elements 110.

Figure 27:
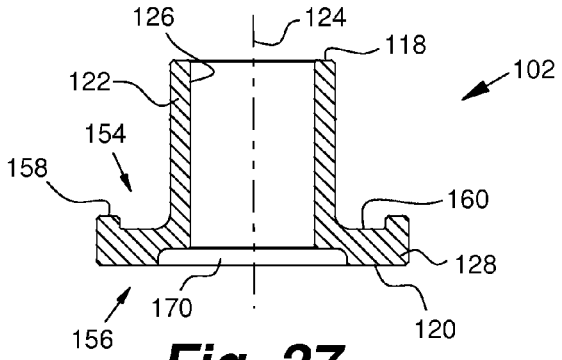
FIG. 27 is a diagrammatic cross-sectional view of a bushing element.
Figure 28:
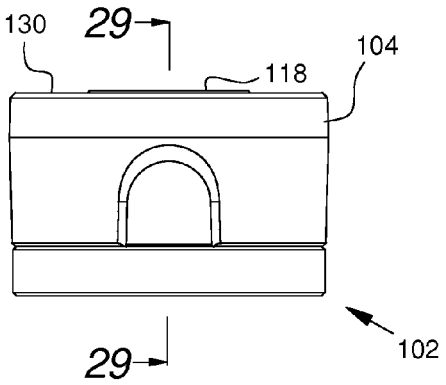
FIG. 28 is a diagrammatic side view of a bushing element and a retainer element of the embodiment shown in FIG. 1, wherein the retainer bore of the retainer element is in rotatable receiving engagement with the cylindrical portion of the bushing member.
Figure 29:
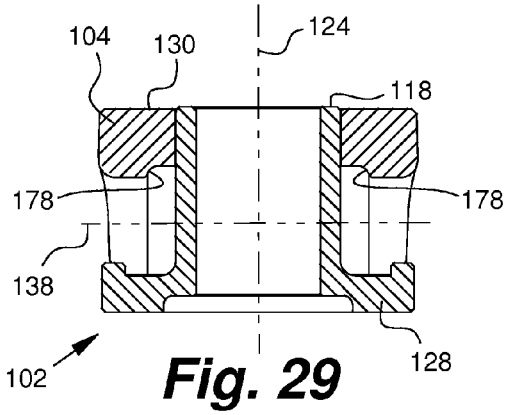
FIG. 29 is a diagrammatic cross-sectional view taken along line 29-29 of FIG. 28.

Referring to FIG. 27 for illustration, the bushing element 102 may have a near end 118, a remote end 120, a cylindrical portion 122 extending generally therebetween along a major axis 124, a bushing bore 126 extending axially through the cylindrical portion 122, and a flange portion 128 extending generally radially outward from the cylindrical portion 122 proximate the remote end 120.

Referring to FIGS. 7-10 for illustration, the retainer element 104 may have a first end 130, a second end 132 and a retainer bore 134 extending therebetween. The retainer element 104 may also have a pair of slotted walls 136 disposed opposingly along a minor axis 138. Each of the slotted walls 136 may have a retainer slot 137 with a slot open end 140 at generally the second end 132, and a slot closed end 174. The retainer bore 134 may be adapted to be in rotatable receiving engagement with the cylindrical portion 122 when the hoist ring assembly 100 is in its assembled configuration (as shown, for example, in FIG. 2).

The threaded fastener element 106 is typically adapted to extend through the bushing bore 126 for securing the hoist ring assembly 100 to a load. The lifting loop element 108 may have a pair of legs 142, wherein each of the legs has a free end 144 and a respective pin bore 146 approximately thereat.

Figure 2:
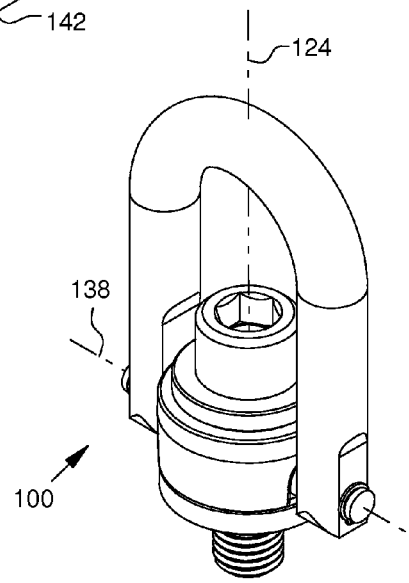
FIG. 2 is a diagrammatic perspective view of the embodiment shown in FIG. 1, in assembled configuration.
Figure 3:
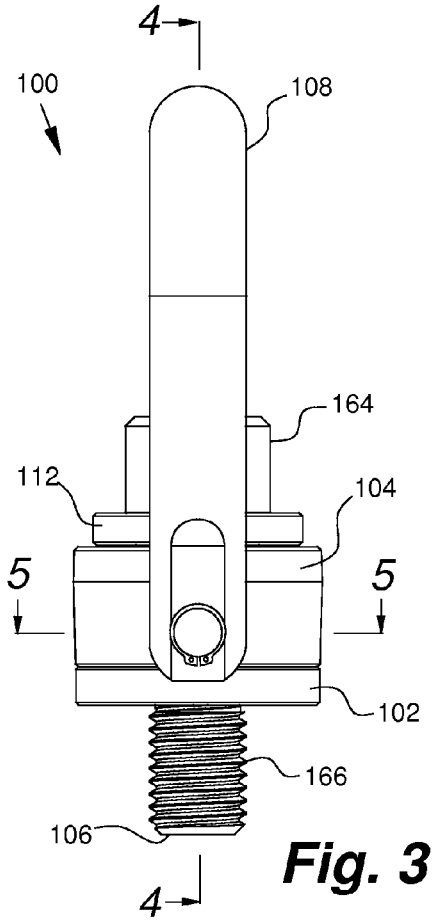
FIG. 3 is a side view of the embodiment shown in FIG. 1, in assembled configuration.
Figure 4:
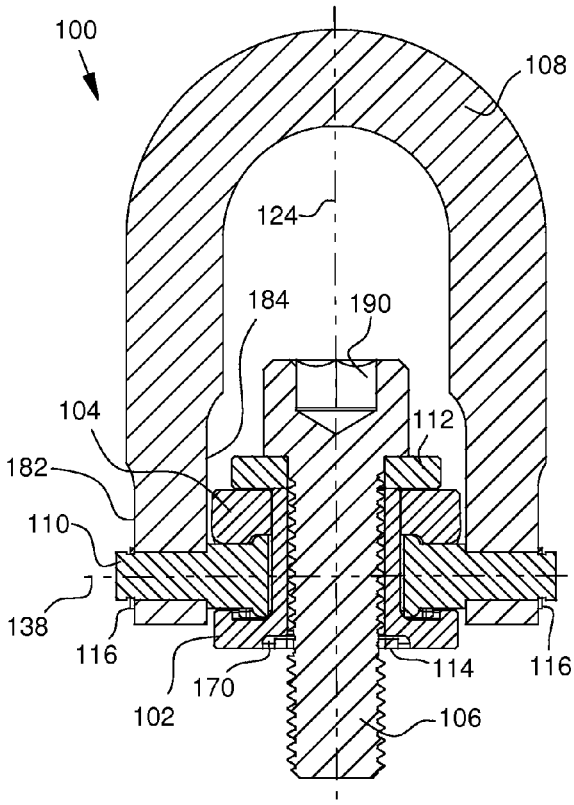
FIG. 4 is a cross-sectional view taken along line 4-4 of FIG. 3.
Figure 6:
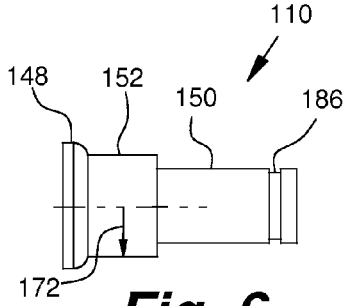
FIG. 6 is a side view of a pin element from the embodiment shown in FIG. 1.
Figure 16:
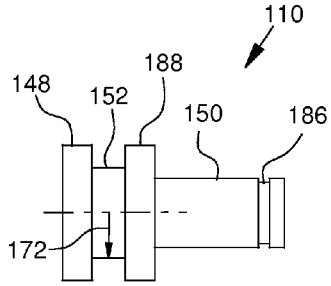
FIG. 16 is a diagrammatic side view of a pin element from the embodiment shown in FIG. 11.
Figure 17:
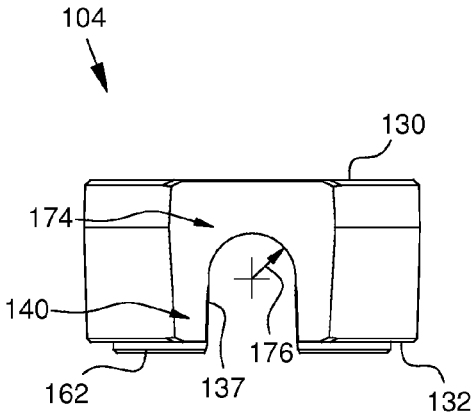
FIG. 17 is a diagrammatic side view of a retainer element from the embodiment shown in FIG. 11.
Figure 18:
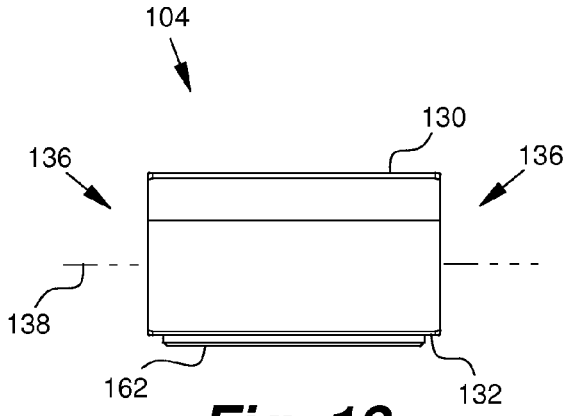
FIG. 18 is a further diagrammatic side view of a retainer element from the embodiment shown in FIG. 11, taken at a right angle from the view in FIG. 17.
Figure 19:
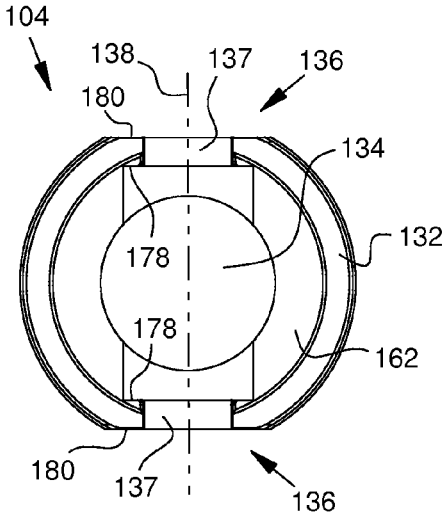
FIG. 19 is a diagrammatic bottom view of a retainer element from the embodiment shown in FIG. 11.
Figure 20:
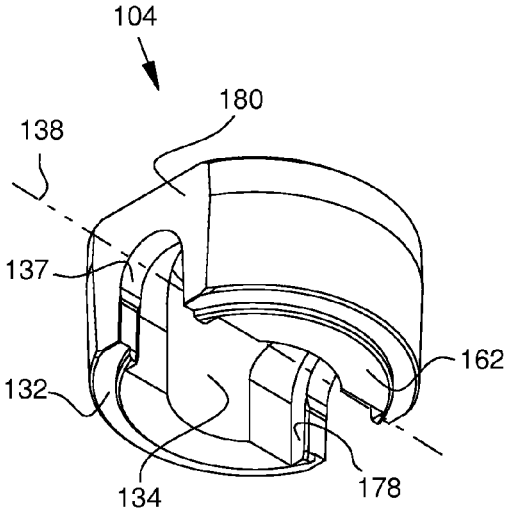
FIG. 20 is a diagrammatic perspective view of a retainer element from the embodiment shown in FIG. 11.
Figure 21:
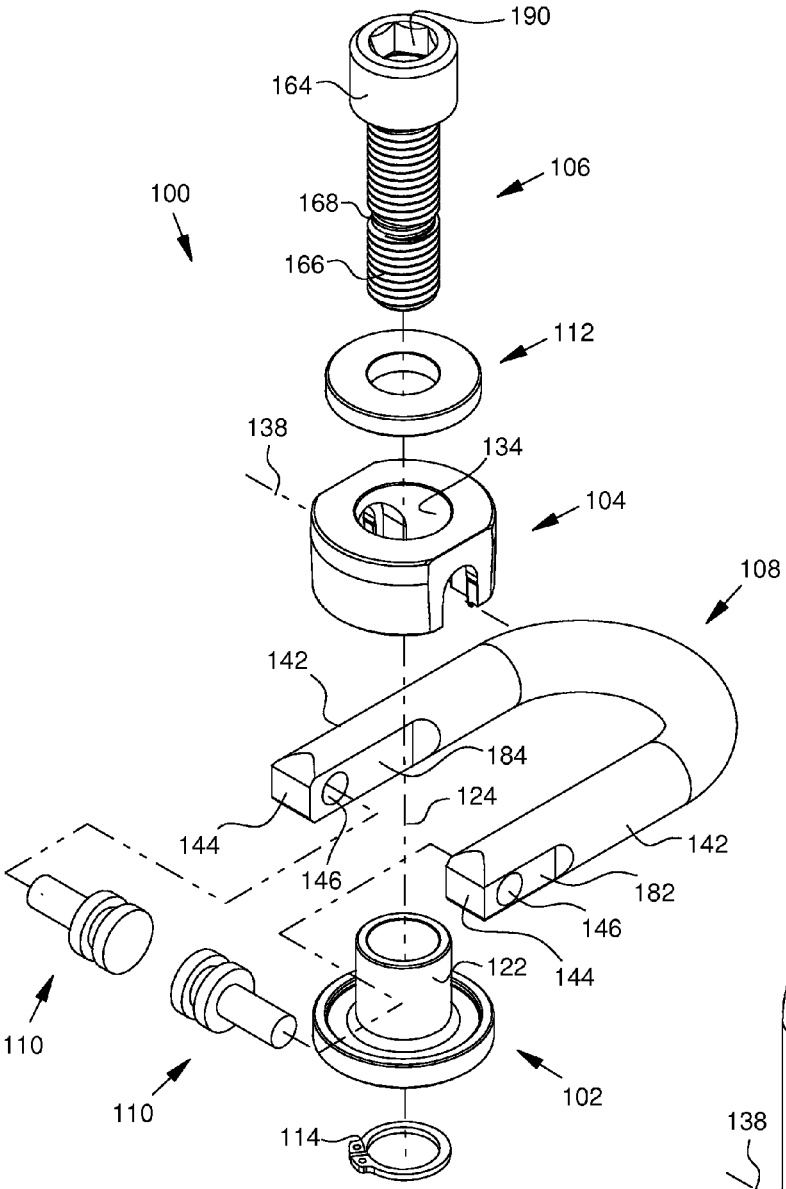
FIG. 21 is a diagrammatic exploded view of an additional embodiment of a hoist ring assembly.
Figure 22:
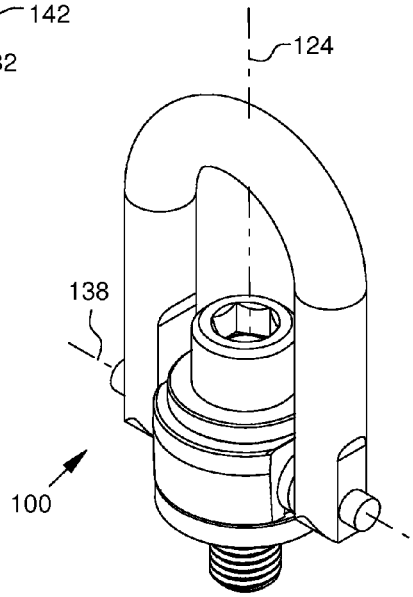
FIG. 22 is a diagrammatic perspective view of the embodiment shown in FIG. 21, in assembled configuration.
Figure 23:
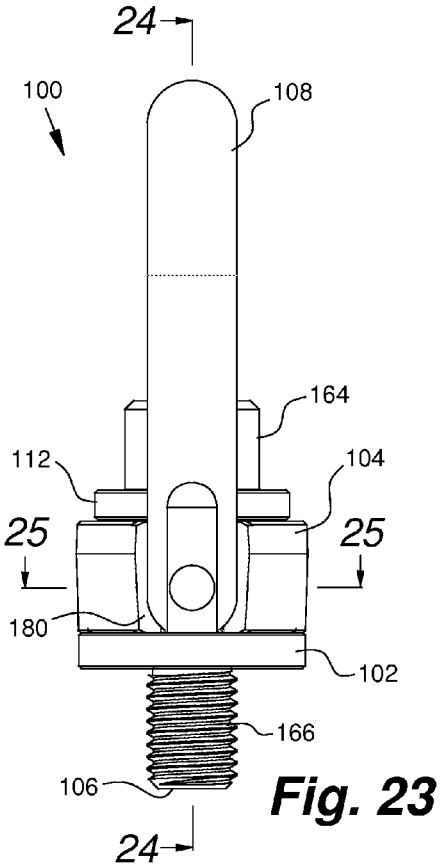
FIG. 23 is a diagrammatic side view of the embodiment shown in FIG. 21, in assembled configuration.
Figure 26:
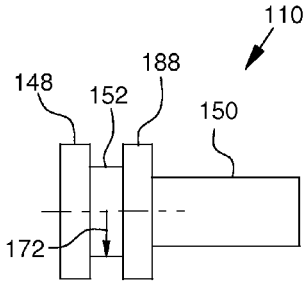
FIG. 26 is a diagrammatic side view of a pin element from the embodiment shown in FIG. 21.

Referring to FIGS. 6, 16 and 26 for illustration, each of the pin elements 110 may have a proximal portion 148, a distal portion 150 and a medial portion 152 therebetween. The distal portion 150 may be adapted to be receivingly engaged by a respective one of the pin bores 146. The medial portion 152 may be adapted to be receivingly engaged by a respective one of the retainer slots 137 such that when the hoist ring assembly 100 is in the assembled configuration the lifting loop element 108 is connectedly associated with the anchor subassembly. Referring to FIGS. 2 and 4, as a result of this arrangement in the assembled configuration, the lifting loop element 108 may be rotatable through a 360-degree angle about the major axis 124 with respect to the bushing element 102 with the minor axis 138 remaining generally perpendicular to the major axis 124, and may be pivotable through at least approximately a 180-degree angle about the minor axis 138 with respect to the anchor subassembly.

Referring again to FIG. 27 for illustration, in certain embodiments, the flange portion 128 may have an obverse face 154, a flange lip 158 protruding therefrom, and an annular groove 160 generally disposed between the flange lip 158 and the cylindrical portion 122. Referring to FIGS. 17-20, in such embodiments, the retainer element 104 may have a boss member 162 protruding from the second end 132 and adapted to be received by the annular groove 160 in rotatably slidable fashion.

Referring to FIGS. 1-4 for illustration, in particular embodiments, the anchor subassembly may include a fastener snap ring 114. Further, the threaded fastener element 106 may have a fastener head 164, a threaded portion 166, and a fastener snap ring groove 168 adapted to be engaged by the fastener snap ring 114. As illustrated in FIG. 1, the fastener snap ring groove 168 may simply take the form of a void in a section of the threaded portion 166. Returning to FIG. 27, the flange portion 128 may have a reverse face 156 proximate the remote end 120. The reverse face may have a snap ring recess 170 proximate the bushing bore 126.

Referring to FIG. 4 for illustration, in embodiments such as those presented for example herein, the hoist ring assembly 100 may comprise an adaptation wherein when the hoist ring assembly 100 is in its assembled configuration, the fastener snap ring 114 is in receiving engagement with the fastener snap ring groove 168 and is positioned generally within the snap ring recess 170. In such a case, the threaded portion 166 may extend outward of the remote end 120 and the fastener head 164 and the fastener snap ring 114 may cooperate to secure the retainer member 104 in rotatable receiving engagement with the cylindrical portion 122.

In embodiments, the anchor subassembly may include a washer element 112 adapted to adjacently engage the near end 118 and receivingly engage and cooperate with the threaded fastener element 106 to axially confine the retainer element 104 in rotatable receiving engagement with the cylindrical portion 122.

Referring once again to FIGS. 6, 16 and 26 for illustration, in particular embodiments, each of the medial portions 152 may have a medial portion radius 172. In such embodiments, the slot closed ends 174 may have a slot radius 176, and the slot radius 176 may be approximately equal to the medial portion radii 172.

Figure 5:
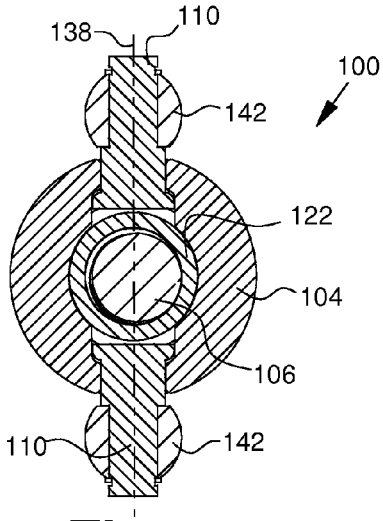
FIG. 5 is a cross-sectional view taken along line 5-5 of FIG. 3.
Figure 7:
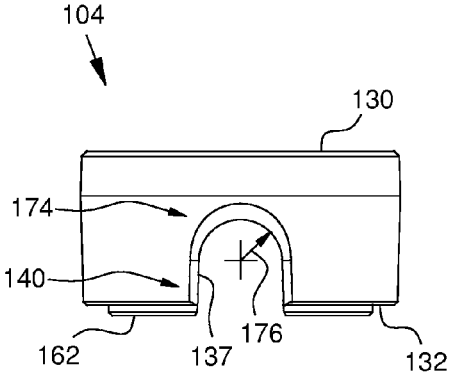
FIG. 7 is a side view of a retainer element from the embodiment shown in FIG. 1.
Figure 8:
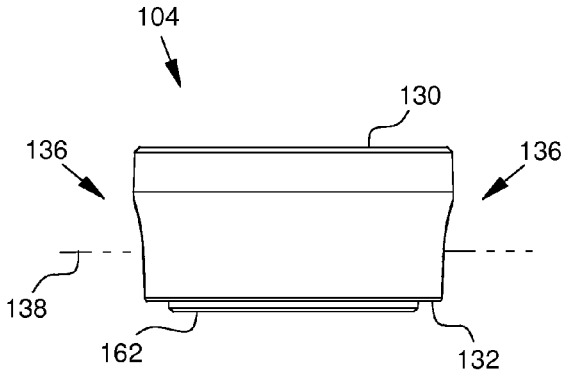
FIG. 8 is a further side view of a retainer element from the embodiment shown in FIG. 1, taken at a right angle from the view in FIG. 7.
Figure 9:
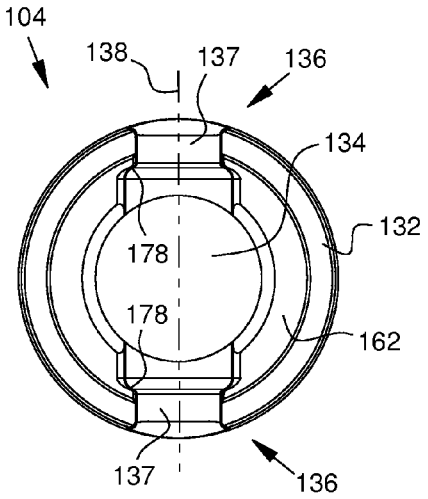
FIG. 9 is a bottom view of a retainer element from the embodiment shown in FIG. 1.
Figure 10:
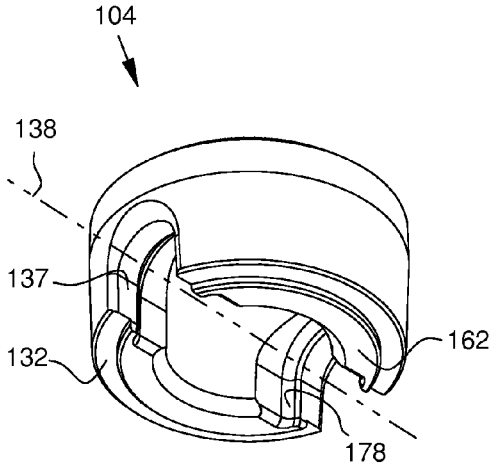
FIG. 10 is a perspective view of a retainer element from the embodiment shown in FIG. 1.
Figure 11:
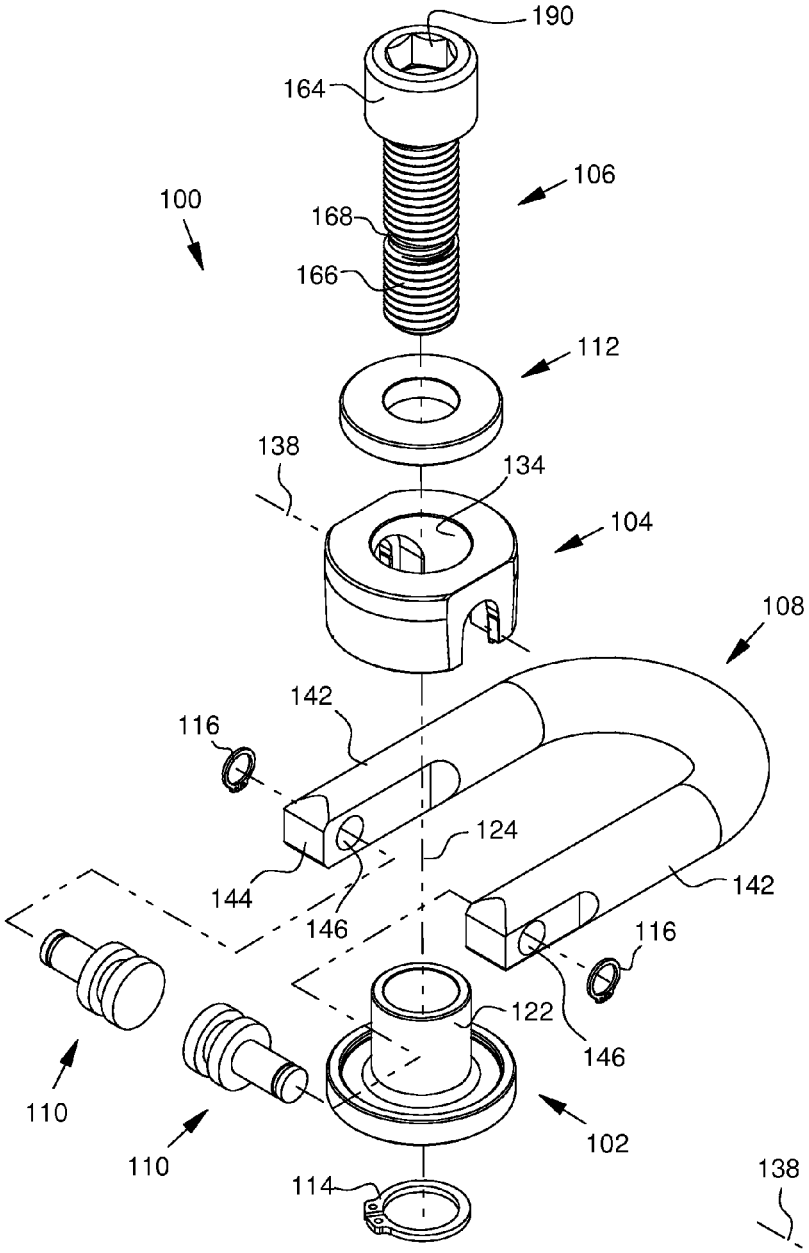
FIG. 11 is an exploded view of a further embodiment of a hoist ring assembly.
Figure 12:
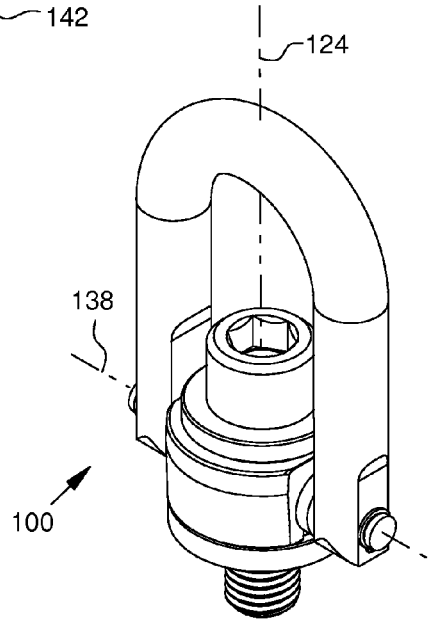
FIG. 12 is a perspective view of the embodiment shown in FIG. 11, in assembled configuration.
Figure 13:
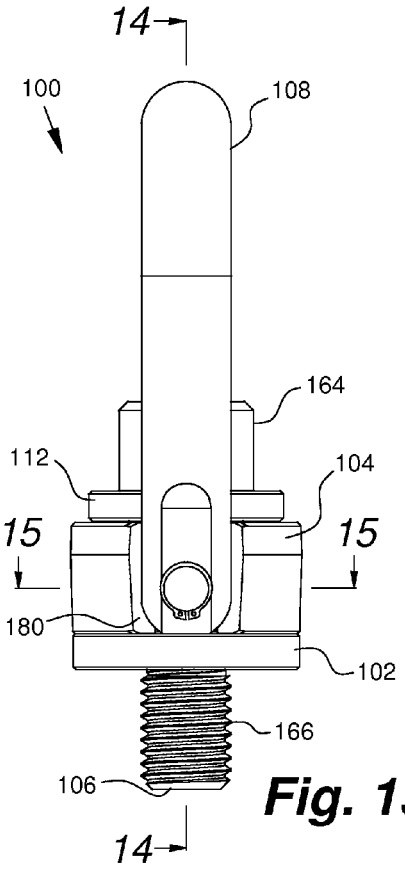
FIG. 13 is a side view of the embodiment shown in FIG. 11, in assembled configuration.

Referring to FIGS. 1, 6 and 7 for illustration, in certain embodiments, each of the pin elements 110 is typically adapted to be placed in receiving engagement with the respective one of the retainer slots 137 by way of the respective slot open end 140. As illustrated in FIGS. 4 and 5, when the hoist ring assembly 100 is in assembled configuration, the pin elements 110 are typically in axially restrained engagement with the anchor subassembly. As a result, the pin element 110 is substantially restrained from axial movement along the minor axis 138 with respect to the anchor subassembly. The proximal portion 148 of each of the pin elements 110 typically extends radially outward of the respective medial portion 152. The axially restrained engagement is therefore typically achieved largely by way of the proximal portion 148 being generally confined between its respective wall inner face and the cylindrical portion 122.

Figure 14:
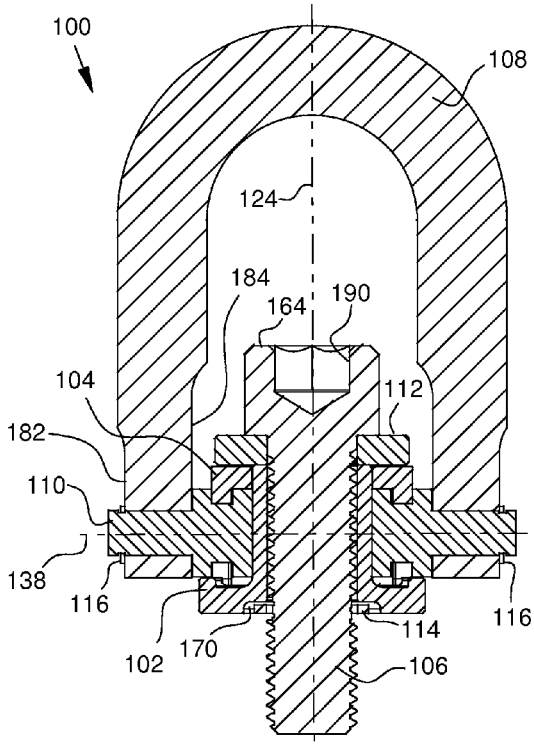
FIG. 14 is a diagrammatic cross-sectional view taken along line 14-14 of FIG. 13.
Figure 15:
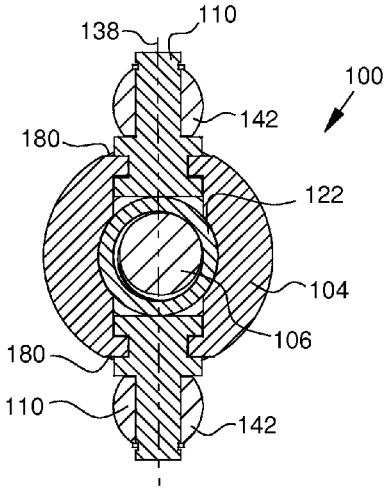
FIG. 15 is a diagrammatic cross-sectional view taken along line 15-15 of FIG. 13.

Referring to FIGS. 4, 14 and 24 for illustration, when the hoist ring assembly 100 is in assembled configuration, the pin elements 110 are in laterally restrained engagement with the anchor subassembly. As a result, the pin element 110 is secured in receiving engagement with the respective one of the retainer slots. The laterally restrained engagement is typically achieved by way of the pin element 110 being trapped in received engagement with the respective one of the retainer slots 137 by the flange portion 128.

In certain embodiments, such as those shown for example in FIGS. 1-5 and 11-15, the loop subassembly includes a pair of pin snap rings 116 and each of the legs 142 may have a leg outer face 182 and a leg inner face 184. In such embodiments, each of the pin elements 110 may have a pin snap ring groove 186 within the distal portion 150 (see, for example, FIGS. 16 and 26). Each of the snap ring grooves 186 are adapted to be engaged by a respective one of the pin snap rings 116 such that each of the pin snap rings 116 is positioned generally adjacent a respective leg outer face 182 when the hoist ring assembly 100 is in its assembled configuration. Certain embodiments, such as the one illustrated, for example in FIGS. 21-25, do not include pin snap rings. Referring to FIG. 32, the load rating of such an embodiment may be increased by configuring the lifting loop element 108 to include a cross-bar member 192, thereby reducing the likelihood that the legs 142 will spread apart when the assembly is subjected to heavier loading. The cross-bar member 192 may be integrally formed as part of the lifting loop element 108.

Referring to FIGS. 11-15 and 21-25, in particular embodiments, each of the pin elements 110 may have an intermediate portion 188 disposed between the medial portion 152 and the distal portion 150 (see, for example, FIG. 16). The intermediate portion 188 typically extends radially outward of the respective medial portion 152. Further, each of the slotted walls 136 may have a wall outer face 180. In such embodiments, the intermediate portion 188 may be adapted to be disposed between the respective one of the outer faces 180 and the respective one of the legs 142 when the hoist ring assembly 100 is in the assembled configuration. Each of the wall outer faces 180 may be substantially flat planar. Additionally, the distance between the proximal portion 148 and the intermediate portion 188 of a pin element 110 may be closely matched with the distance between the respective wall inner face 178 and wall outer face 180.

A process of forming a hoist ring assembly 100 generally comprises a series of formation and assembly steps. Some of the steps are not necessarily required to be performed in any particular order. The bushing element 102, retainer element 104, pin elements 110, lifting loop element 108 and washer element 112 may each be independently formed entirely by way of forging, machining operations, a combination thereof, or alternate processes. However, embodiments in accordance with the present invention may be particularly well adapted to enable the retainer member 104 to be forged rather than machined in its entirety. This may result in lower manufacturing costs. Further, embodiments in accordance with the present invention may be well suited to allow for a short run production of custom lifting loop elements 108 which can then be used in combination with forged retainer members 104 produced in large batches at a significant cost savings.

The terms "forging," "forged," and forge," and similar terms, as used herein are intended to include related operations such as, for example, cold heading. In a cold heading operation the metal is annealed to its softest condition and after cooling the soft metal is formed to the desired configuration in a suitable die.

With the various elements and components having been formed or otherwise acquired, the hoist ring assembly 100 can be assembled. The distal portions 150 of each of the pin elements 110 may be inserted into a respective one of the pin bores 146. The medial portions 152 of the pin elements 110 may then be placed into received engagement with a respective one of the retainer slots 137 by way of the respective slot open ends 140. The retainer element 104 may next be placed into rotatable receiving engagement with the cylindrical portion 122 by axially sliding the retainer bore 134 over the cylindrical portion 122. A washer element 112 may be placed in receiving engagement with the threaded fastener element 106. The retainer element 104 may then be fastened in rotatable receiving engagement with the cylindrical portion 122 by way of a threaded faster element inserted through the bushing bore. The threaded fastener element 106 can then be secured in rotatable inserted engagement with the bushing element 102 by way of a fastener snap ring 114 being placed in engagement with the fastener snap ring groove 168, thereby securing the hoist ring assembly 100 in assembled configuration. The hoist ring assembly 100 can be shipped to the customer in assembled configuration, and secured to a load by threaded engagement between the threaded fastener element and a threaded bore within the load or structurally associated therewith. The fastener head 164 may feature a polygonal recess 190 for engaging a tool to aid in the rapid and tight securement of the hoist ring assembly to the load and removal therefrom.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A hoist ring assembly comprising:

an anchor subassembly including:

(i) a bushing element having a near end, a remote end, a cylindrical portion extending generally therebetween along a major axis, a bushing bore extending axially through the cylindrical portion, and a flange portion extending generally radially outward from the cylindrical portion proximate the remote end;

(ii) a retainer element having a first end and a second end, a retainer bore extending therebetween, a pair of slotted walls disposed opposingly along a minor axis, each of the slotted walls having a retainer slot, each of the retainer slots having a slot open end at generally the second end, the retainer bore being adapted to be in rotatable receiving engagement with the cylindrical portion when the hoist ring assembly is in an assembled configuration; and (iii) a threaded fastener element adapted to extend through the bushing bore for securing the hoist ring assembly to a load; and a loop subassembly including:

(i) a lifting loop element having a pair of legs, each of the legs having a free end and a pin bore approximately thereat; and (ii) a pair of pin elements, each of the pin elements having a proximal portion, a distal portion and a medial portion therebetween, the distal portion being adapted to be receivingly engaged by a respective one of the pin bores and the medial portion being adapted to be receivingly engaged by a respective one of the retainer slots such that when the hoist ring assembly is in the assembled configuration the lifting loop element is connectedly associated with the anchor subassembly and is:

(1) rotatable through a 360-degree angle about the major axis with respect to the bushing element with the minor axis remaining generally perpendicular to the major axis; and (2) pivotable through at least approximately a 180-degree angle about the minor axis with respect to the anchor subassembly;

wherein each of the pin elements is adapted to be:

(i) placed in receiving engagement with the respective one of the retainer slots by way of the respective slot open end;

(ii) in axially restrained engagement with the anchor subassembly wherein the pin element is substantially restrained from axial movement along the minor axis with respect to the anchor subassembly when the hoist ring assembly is in the assembled configuration; and (iii) in laterally restrained engagement with the anchor subassembly wherein the pin element is secured in receiving engagement with the respective one of the retainer slots when the hoist ring assembly is in the assembled configuration; and wherein:

(i) each of the slotted walls has an wall inner face;

(ii) the proximal portion of each of the pin elements extends radially outward of the respective medial portion;

(iii) the axially restrained engagement is achieved by way of the proximal portion being generally confined between the respective inner face and the cylindrical portion when the hoist ring assembly is in the assembled configuration;

(iv) the loop subassembly includes a pair of pin snap rings;

(v) each of the legs has a leg outer face; and (vi) each of the pin elements has a pin snap ring groove within the distal portion, each of the snap ring grooves being adapted to be engaged by a respective one of the pin snap rings such that each of the pin snap rings is positioned generally adjacent a respective leg outer face when the hoist ring assembly is in the assembled configuration.

2. A hoist ring assembly comprising:

an anchor subassembly including:

(i) a bushing element having a near end, a remote end, a cylindrical portion extending generally therebetween along a major axis, a bushing bore extending axially through the cylindrical portion, and a flange portion extending generally radially outward from the cylindrical portion proximate the remote end;

(ii) a retainer element having a first end and a second end, a retainer bore extending therebetween, a pair of slotted walls disposed opposingly along a minor axis, each of the slotted walls having a retainer slot, each of the retainer slots having a slot open end at generally the second end, the retainer bore being adapted to be in rotatable receiving engagement with the cylindrical portion when the hoist ring assembly is in an assembled configuration; and (iii) a threaded fastener element adapted to extend through the bushing bore for securing the hoist ring assembly to a load; and a loop subassembly including:

(i) a lifting loop element having a pair of legs, each of the legs having a free end and a pin bore approximately thereat; and (ii) a pair of pin elements, each of the pin elements having a proximal portion, a distal portion and a medial portion therebetween, the distal portion being adapted to be receivingly engaged by a respective one of the pin bores and the medial portion being adapted to be receivingly engaged by a respective one of the retainer slots such that when the hoist ring assembly is in the assembled configuration the lifting loop element is connectedly associated with the anchor subassembly and is:

(1) rotatable through a 360-degree angle about the major axis with respect to the bushing element with the minor axis remaining generally perpendicular to the major axis; and (2) pivotable through at least approximately a 180-degree angle about the minor axis with respect to the anchor subassembly;

wherein each of the pin elements is adapted to be:

(i) placed in receiving engagement with the respective one of the retainer slots by way of the respective slot open end;

(ii) in axially restrained engagement with the anchor subassembly wherein the pin element is substantially restrained from axial movement along the minor axis with respect to the anchor subassembly when the hoist ring assembly is in the assembled configuration; and (iii) in laterally restrained engagement with the anchor subassembly wherein the pin element is secured in receiving engagement with the respective one of the retainer slots when the hoist ring assembly is in the assembled configuration; and wherein:

(i) each of the slotted walls has an wall inner face;

(ii) the proximal portion of each of the pin elements extends radially outward of the respective medial portion;

(iii) the axially restrained engagement is achieved by way of the proximal portion being generally confined between the respective inner face and the cylindrical portion when the hoist ring assembly is in the assembled configuration;

(iv) each of the slotted walls has a wall outer face;

(v) each of the pin elements has an intermediate portion disposed between the medial portion and the distal portion, the intermediate portion extending radially outward of the respective medial portion; and (vi) the intermediate portion is adapted to be disposed between the respective one of the outer faces and the respective one of the legs when the hoist ring assembly is in the assembled configuration.

3. A hoist ring assembly as defined in claim 2 in which each of the wall outer faces are substantially flat planar.

4. A hoist ring assembly as defined in claim 2 in which the distance between the proximal portion and the intermediate portion of each of the pin elements is closely matched with the distance between the respective wall inner face and wall outer face.

* * * * *